US006052403A

United States Patent [19]

Brückner et al.

[11] Patent Number: 6,052,403

[45] Date of Patent: Apr. 18, 2000

[54] INDUCTOR IN A FUSION TANK

[75] Inventors: Raimund Brückner, Niedernhausen; Daniel Grimm, Bad Schwalbach, both of Germany

[73] Assignee: Didier Werke AG, Wiesbaden, Germany

[21] Appl. No.: 09/319,383

[22] PCT Filed: Nov. 28, 1997

[86] PCT No.: PCT/DE97/02784

§ 371 Date: Jun. 4, 1999

§ 102(e) Date: Jun. 4, 1999

[87] PCT Pub. No.: WO98/25718

PCT Pub. Date: Jun. 18, 1998

[30] Foreign Application Priority Data

Dec. 12, 1996 [DE] Germany ..... 196 51 525

[51] Int. Cl.[7] ..... F27D 3/00

[52] U.S. Cl. ..... 373/142; 373/59; 373/79

[58] Field of Search ..... 373/42, 45, 48, 373/59, 66, 79, 83, 85, 107, 142, 144, 146, 154; 164/459, 418, 485, 443; 266/44

[56] References Cited

U.S. PATENT DOCUMENTS

| | | | |
|---|---|---|---|
| 1,681,950 | 8/1928 | Northrup | 373/142 |
| 2,277,223 | 3/1942 | Goodridge | 373/142 |
| 3,014,255 | 12/1961 | Bussard et al. | 373/142 |
| 4,455,014 | 6/1984 | Genies | 266/44 |
| 4,972,899 | 11/1990 | Tungatt | 164/459 |
| 5,479,438 | 12/1995 | Blum et al. | 373/156 |
| 5,901,169 | 5/1999 | Kobayashi | 373/142 |

FOREIGN PATENT DOCUMENTS

| | | |
|---|---|---|
| 0 300 150 | 4/1989 | European Pat. Off. . |
| 0 526 718 | 6/1993 | European Pat. Off. . |
| 24 33 582 | 2/1975 | Germany . |
| 3439369 | 4/1986 | Germany . |
| 44 28 297 | 2/1996 | Germany . |
| 195 00 012 | 7/1996 | Germany . |

OTHER PUBLICATIONS

Patent Abstract of Japan 60021170, Feb. 1985.

*Primary Examiner*—Tu Ba Hoang
*Attorney, Agent, or Firm*—Wenderoth, Lind & Ponack, L.L.P.

[57] ABSTRACT

An inductor is used to generate an electromagnetic AC field at a pipe-in-pipe discharge element of a metallurgical vessel. The inductor has at least two cooling fluid regions for the flow of cooling fluid therethrough. First supply and drain lines are connected to a first of the cooling fluid regions for supplying the first cooling fluid thereto. Second supply and drain lines are connected to a second region. The second cooling fluid is different than the first cooling fluid so that separate regions can be separately cooled with different cooling fluids having different properties.

24 Claims, 1 Drawing Sheet

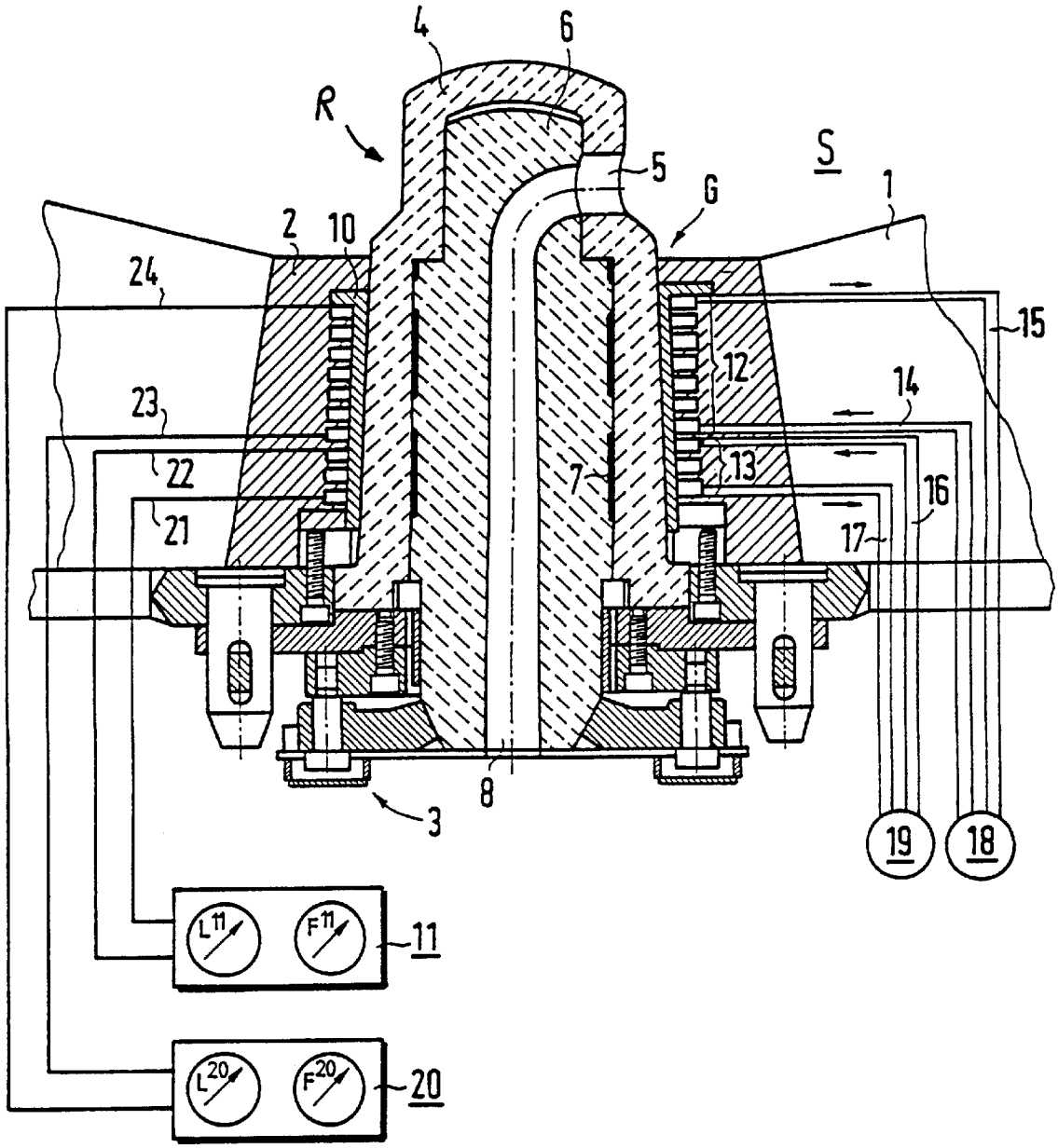
4
6
R
5
S
G
1
2
10
24
15
12
14
23
22
13
7
16
21
17
8
3
19
18
11
20

INDUCTOR IN A FUSION TANK

This application is a 371 of PTC/DE97/02784 filed on Nov. 28, 1997.

BACKGROUND OF THE INVENTION

1. Field of the Invention

The invention relates to an inductor for generating an electromagnetic AC field at a discharge element of a melt vessel through which, for the purpose of cooling, flows a cooling fluid.

2. State of the Prior Art

In DE 195 00 012 A1 is described an inductor in a regulation and closure device of a metallurgical vessel which comprises a stator disposed in the vessel wall and a rotor rotatable in the stator for choking or shutting off the melt flow (a pipe-in-pipe closure system). Cooling takes place uniformly by means of a single cooling fluid. For reasons of safety, compressed air is used as the cooling fluid so that in the event of leakage, for example through wear of the vessel wall, water vapor or oxyhydrogen gas cannot develop.

In an older patent application, 196 03 317.9-34, it is specified that the inductor, during an operating phase, is cooled with liquid gas, and with air during a stand-by phase. Cooling with water is also avoided here.

GB 22 79 543 A describes a two-part inductor with separate electrical connections at the discharge element of a melt vessel. Nothing is mentioned about cooling.

SUMMARY OF THE INVENTION

It is an object of the present invention to provide an inductor of the above described type so that it can be operated with differing cooling means for the purpose of being able to adapt to various cooling requirements.

According to the present invention, the above object is achieved through the following characteristics of the invention. An inductor is provided with different regions with separate conveyances for conveying the cooling fluid to and from the region. It is thereby possible to act upon the differing regions of the inductor simultaneously or successively with different cooling fluids. This permits the cooling in the individual regions to be adapted to the particular requirements obtaining at the regions. It is, in particular, possible to carry out cooling in a region in the proximity of a danger zone in which the use of water as a cooling means is dangerous, by means of a gas, and in particular by air. The danger zone is located where the inductor is closest to the melt disposed in the melt vessel because at this location, due to wear and/or the formation of cracks in the wall of the melt vessel, it is possible for the melt to come into contact with the inductor. In other regions, water or water vapor can be used for cooling.

For a particular region of the inductor, the cooling fluid is always used which, in each instance, is most suitable for cooling the region and its environment. The various cooling fluids are preferably liquid gas or dry ice or water or water vapor or gas or compressed air. When using gases as the cooling fluid, which is especially preferred in danger zones, it is also possible, in order to adapt to the cooling performance required in each instance, to use a variably adjustable ratio of several gases, for example compressed air and supercooled air or nitrogen or carbon dioxide or oxygen or the like. By using differing cooling fluids, and thus different cooling performances, in the individual regions of the inductor, the electromagnetic AC field generated by the inductor can be utilized for differing functions. These include, in particular, inductive heating and/or the generation of a reference field for temperature measurements and/or slag detection and/or generation of a directed electromagnetic field for the purpose of exerting a force component onto the melt, which, for example, can be used for gap sealing in the discharge element.

The regions of the inductor can preferably be acted upon with differing electric frequencies and/or differing electric powers depending on the purpose of the particular region.

BRIEF DESCRIPTION OF THE DRAWING

Further advantages and features of the present invention will become evident from the following description of a preferred embodiment with reference to the accompanying FIGURE.

The FIGURE depicts an inductor for a discharge element, implemented as a pipe-in-pipe rotary closure, at the bottom of a melt vessel.

DETAILED DESCRIPTION OF THE PREFERRED EMBODIMENT

In a bottom (1) of a melt vessel, for example for a steel melt, a pipe-in-pipe closure system (R) is installed. It comprises a nozzle brick (2) in which, by means of a mounting device (3), a stator (4) comprising a refractory ceramic material is fastened. In the stator (4), which has a melt inlet opening (5), a rotor (6) comprising a refractory ceramic material is rotatably supported. Between stator (4) and rotor (6) exists a gap (7). Within the rotor (6) a melt outflow channel (8) is formed. By rotating the rotor (6) its melt outflow channel (8) can be moved to coincide more, less or not at all with the inlet opening (5), whereby the melt outflow can be controlled or interrupted.

The stator (4) is encompassed by a coil-form inductor (9) which is built into the nozzle brick (2) and is in contact with the stator (4) via insulation (10). The inductor (9) comprises a hollow chamber-form metal section and is connected to an electric frequency converter (11) whose frequency and/or power are adjustable.

With respect to its conductance of cooling fluid, the inductor (9) is divided into an upper region (12) and a lower region (13). The upper region (12) is in closer proximity to melt (S) in the vessel. It is close to a danger zone (G) in which, during operation, wear or the formation of cracks must be anticipated. The lower region (13) is further removed from this zone. The upper region (12) comprises a supply line (14) and a drain line (15). The lower region (13) comprises a supply line (16) and a drain line (17) for a different cooling fluid. The supply line (14) supplies cooling fluid from a first cooling fluid source (18). The supply line (16) supplies cooling fluid from a second cooling fluid source (19). The cooling fluid for the upper region (12) is a gas, in particular a compressed gas. The cooling fluid for the lower region (13) is liquid petroleum gas or dry ice or water or water vapor, however, the cooling fluids are changeable depending on the application. From the first cooling fluid source (18) and the second cooling fluid source (19), the regions (12, 13) can be cooled independently of one another with respect to the type of cooling fluid and the cooling performance.

As in the case with respect to cooling, in which the inductor (9) is divided into regions (12, 13), it can also be divided electrically into differing regions. To these regions can be connected differing frequencies and/or powers. In the FIGURE, accordingly, to the lower region (13) is connected a frequency converter or transformer (11) by means of electrical connection (21, 22). To the upper region (12) is connected a further frequency converter or transformer (20) by means of electrical connections (23, 24). The frequencies and/or powers of the converters or transformers (11, 20) are adjustable.

In particular, the upper region (12) is used for the inductive heating of the melt flowing through the outflow channel (8). Herein either the steel melt itself can be coupled to the electromagnetic AC field of the inductor (9), or the rotor (6) and/or the stator (4) can be coupled to the electromagnetic AC field and subsequently the melt is heated, if applicable, through thermal conduction or heat radiation. The cooling takes place in order to protect the inductor against overheating and, if appropriate, to dissipate heat from its environment.

The lower region (13) can also be used for the inductive heating of the melt flowing through the outflow channel (8). Its cooling can be stronger than in the upper region (12) through the corresponding selection of the cooling fluid and/or its throughflow rate. Through intensive cooling, heat dissipation from the environment (the nozzle brick) is also possible here.

The lower region (13) can also serve as a reference coil or reference field for temperature measurement of the melt flowing through the outflow channel (8). For this purpose a further (receiver) coil is required (not shown). In this case the lower region (13) is connected to a measuring device (not shown). Since the electrical properties, in particular the conductivity, of the melt is a function of the temperature, it has a different effect on the reference field of the lower region (13) depending on the temperature detected and evaluated by the measuring device. The same applies also to slag detection since slag has a different electrical conductivity than the melt. Herein also the cooling of region (13) can be selected independently of the cooling in region (12).

The lower region (13) can also be utilized for generating a directed electromagnetic field which generates in melt which potentially has penetrated into gap (7) a force component which counteracts the melt flow. Sealing of the gap (7) is thereby attained. In this case intensive cooling is favorable since high electric power is required for generating the force component.

The described inductor can be used in other discharge systems in a wall or bottom of a metallurgical vessel for teeming liquid metals, in particular steel. But it can also be applied in arrangements for slag run-off in, for example, disposal incinerators.

What is claimed is:

1. An apparatus comprising:

a discharge element for a melt vessel;

an inductor for generating an electromagnetic AC field disposed at said discharge element, said inductor having at least two cooling fluid flow regions for the flow of cooling fluid therethrough;

first supply and drain lines connected to a first region of said at least two cooling fluid flow regions for supplying a first cooling fluid thereto; and second supply and drain lines connected to a second region of said at least two cooling fluid flow regions for supplying a second cooling fluid thereto, the second cooling fluid being different than the first cooling fluid.

2. The apparatus of claim 1, wherein the first and second cooling fluids are selected from the group consisting of liquid petroleum gas, dry ice, water, water vapor, and gas.

3. The apparatus of claim 2, wherein the gas is compressed air.

4. The apparatus of claim 1, wherein the second cooling fluid is selected from the group consisting of liquid petroleum gas, dry ice, water, and water vapor, and the first cooling fluid is gas.

5. The apparatus of claim 4, wherein the gas is compressed air.

6. The apparatus of claim 1, wherein said at least two regions of said inductor have separate electrical connections.

7. The apparatus of claim 6, wherein said at least two regions of said inductor are electrically connected to respective sources of electrical power which have at least one of different electric frequencies and different electric power outputs.

8. The apparatus of claim 1, wherein said at least two regions of said inductor have an electromagnetic AC field used for inductive heating and used as, in at least one of said at least two regions, a reference field for one of temperature measurement and slag detection.

9. The apparatus of claim 1, wherein said at least two regions of said inductor have an electromagnetic AC field used for at least one of (a) inductive heating, (b) as a reference field for one of temperature measurement and slag detection, and (c) generating a directed electromagnetic field for exerting a force component onto the melt.

10. The apparatus of claim 1, wherein said at least two regions of said inductor have a first electromagnetic AC field used for inductive heating, at least one second electromagnetic AC field used as a reference field for at least one of temperature measurement and slag detection, and a third electromagnetic AC field for generating a directed electromagnetic field for exerting a force component onto the melt.

11. The apparatus of claim 1, wherein said discharge element comprises a pipe-in-pipe closure system.

12. The apparatus of claim 1, wherein said discharge element is located in one of a wall and a bottom of a metallurgical vessel used for teeming liquid metals.

13. A method of pouring a melt from a vessel, comprising:

pouring the melt from the vessel through a pipe-in-pipe closure system;

generating an electromagnetic AC field in an inductor disposed at said discharge element, said inductor having at least two cooling fluid flow regions for the flow of cooling fluid therethrough;

supplying a first cooling fluid to a first region of said at least two cooling fluid flow regions through first supply and drain lines connected thereto; and supplying a second cooling fluid to a second region of said at least two cooling fluid flow regions through second supply and drain lines connected thereto, the second cooling fluid being different than the first cooling fluid.

14. The method of claim 13, wherein the pipe-in-pipe closure system has an annular gap into which melt penetrates, and wherein said generating an electromagnetic AC field in the inductor creates a force on the melt in the annular gap directed counter to the direction of flow of the melt.

15. The method of claim 13, wherein said pouring comprises pouring liquid metal as the melt from a metallurgical vessel.

16. The method of claim 14, wherein the first and second cooling fluids are selected from the group consisting of liquid petroleum gas, dry ice, water, water vapor, and gas.

17. The method of claim 16, wherein the gas is compressed air.

18. The method of claim 14, wherein the second cooling fluid is selected from the group consisting of liquid petroleum gas, dry ice, water, and water vapor, and the first cooling fluid is gas.

19. The method of claim 18, wherein the gas is compressed air.

20. The method of claim 24, wherein said at least two regions of said inductor have separate electrical connections.

21. The method of claim 20, wherein said at least two regions of said inductor are electrically connected to respective sources of electrical power which have at least one of different electric frequencies and different electric power outputs.

22. The method of claim 14, wherein said generating comprises using the electromagnetic AC field in the at least two regions for inductive heating and generating, in at least one of the at least two regions, a reference field used for one of temperature measurement and slag detection.

23. The method of claim 14, wherein said generating comprises using the electromagnetic AC field for at least one of (a) inductive heating, (b) as a reference field for one of temperature measurement and slag detection, and (c) generating a directed electromagnetic field for exerting a force component onto the melt.

24. The method of claim 14, wherein said generating comprises generating, in at the least two regions of said inductor, a first electromagnetic AC field used for inductive heating, at least one second electromagnetic AC field used as a reference field for at least one of temperature measurement and slag detection, and a third electromagnetic AC field for generating a directed electromagnetic field for exerting a force component onto the melt.

* * * * *

UNITED STATES PATENT AND TRADEMARK OFFICE

CERTIFICATE OF CORRECTION

PATENT NO. : 6,052,403
DATED : April 18, 2000
INVENTOR(S) : Raimund Brückner et al.

It is certified that error appears in the above-identified patent and that said Letters Patent is hereby corrected as shown below:

Title page,
Correct the priority date to read:
-- [30] Priority Date: December 11, 1996 --

Signed and Sealed this

Twenty-first Day of August, 2001

*Attest:*

Nicholas P. Godici

NICHOLAS P. GODICI
*Acting Director of the United States Patent and Trademark Office*

*Attesting Officer*